US009246277B2

(12) United States Patent
Chen et al.

(10) Patent No.: US 9,246,277 B2
(45) Date of Patent: Jan. 26, 2016

(54) ELECTRICAL CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Fu-Yi Xu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/632,796

(22) Filed: Feb. 26, 2015

(65) Prior Publication Data

US 2015/0349466 A1 Dec. 3, 2015

(30) Foreign Application Priority Data

Feb. 27, 2014 (CN) ..... 2014 1 0067620

(51) Int. Cl.
*H01R 13/648* (2006.01)
*H01R 13/6581* (2011.01)

(52) U.S. Cl.
CPC ..... *H01R 13/6581* (2013.01)

(58) Field of Classification Search
CPC ..... H01R 23/688; H01R 23/025
USPC ..... 439/607.11, 607.07–607.09, 607.32, 439/101, 676
See application file for complete search history.

(56) References Cited

U.S. PATENT DOCUMENTS 7,736,184 B1 * 6/2010 Wan ..... H01R 13/648 439/607.11
7,909,653 B1 * 3/2011 Wan ..... H01R 13/514 439/660
8,137,137 B1 * 3/2012 Chang ..... H01R 13/514 439/607.07
8,152,568 B2 * 4/2012 Wu ..... H01R 13/6658 439/353
8,545,273 B1 * 10/2013 Chen ..... H01R 13/6658 439/660

* cited by examiner

*Primary Examiner* — Phuongchi T Nguyen
(74) *Attorney, Agent, or Firm* — Novak Druce Connolly Bove + Quigg LLP

(57) ABSTRACT

Electrical connector includes an insulative body, first and second terminals, shielding housing, and adhesive. The insulative body has a tongue piece and a base having first and second positioning grooves. Each of the first terminals has a first positioning part received in the insulative body, a first electrical contact part exposed from the tongue piece, and a first bonding part accommodated in a corresponding one of the first positioning grooves and protruding from the base. Each of the second terminals has a second positioning part received in the base, a second electrical contact part exposed from the tongue piece, and a second bonding part accommodated in a corresponding one of the second positioning grooves and protruding from the base. Adhesive is injected into the first and second positioning grooves to encapsulate the first bonding parts in the first positioning grooves and the second bonding parts in the second positioning grooves.

10 Claims, 10 Drawing Sheets

ELECTRICAL CONNECTOR

CROSS-REFERENCE TO RELATED APPLICATIONS

This application claims priority to Chinese Patent Application No. 201410067620.7 filed Feb. 27, 2014, which is incorporated herein by reference.

BACKGROUND OF THE INVENTION

1. Field of the Invention

The present invention relates to electrical connectors, and, more particularly to an electrical connector for electrically connecting a peripheral device to an electronic product.

2. Description of Related Art

As the electronic products develop rapidly, Universal Serial Bus (USB) type of interface is becoming one of the most popular connectors nowadays. More specifically, most peripheral products of computers are provided with USB connector for data transfer.

Since USB 2.0 introduced by USB-IF has been widely used in various electronic products, USB-IF has introduced even higher speed USB. 3.0, which is not only compatible with US.2.0 connector, but also provides a data transfer rate as high as 5 Gbps. With this specification, more computer devices, which were originally designed to be built in the computers, can be connected as an external peripheral device via an interface.

Referring to FIG. 1, a schematic view of a conventional electrical connector 1000 is shown. The electrical connector comprises an insulative body 10, a plurality of terminals 11, and a housing 12. The terminals 11 penetrate the insulative body 10. The housing 12 receives the insulative body 10. The insulative body 10 has a carrier seat 101 extending from the backside of the insulative body 10, and a bump 102 positioned on the carrier seat 101. However, it is difficult to fabricate the assembly of the bump 102 and hard to implement in an automatic process. Therefore, the efficiency for fabrication is diminished. Moreover, the more the accessories, the process of assembly will be even more complicated, causing the fabricating cost to be undesirably increased.

The present invention provides an electrical connector that, unlike conventional technology, can save the assembly cost for assemble the electrical connector and assembly module, and to provide better positioning for the terminals as well.

SUMMARY OF THE INVENTION

In view of the foregoing problems, the present invention provides an electrical connector, comprising: an insulative body comprising a base and a tongue piece protruding from the base, the base having a plurality of first positioning parts, a plurality of first positioning grooves each formed between corresponding two of the first positioning parts, a plurality of second positioning parts, and a plurality of second positioning grooves each formed between corresponding two of the second positioning parts; a plurality of first terminals penetrating and disposed in the insulative body, each of the first terminals having a first position part received in the insulative body, a first bonding part outwardly bending from the first positioning part, accommodated in a corresponding one of the first positioning grooves and protruding from the base, and a first electrical contact part outwardly bending from the first positioning part and exposed from the tongue piece; a plurality of second terminals penetrating and disposed in the insulative body, each of the second terminals having a second positioning part received in the insulative body, a second bonding part outwardly bending from the second positioning part, accommodated in a corresponding one of the second positioning grooves, and protruding from the base, and a second electrical contact part outwardly bending from the second positioning part and exposed from the tongue piece; an adhesive filled in the first positioning grooves to be coupled with the first positioning part and encapsulate the first bonding part within the first positioning groove, and filled in the second positioning grooves to be coupled with the second positioning part and encapsulate the second bonding part within the second positioning groove; and a shielding housing for receiving the insulative body, the plurality of first terminals and the plurality of second terminals, wherein an an accommodating space is formed between the shielding housing and the tongue piece to function as a space for a peripheral device to be plugged thereinto.

In an embodiment, the adhesive is a thermal-melting adhesive. In an embodiment, the base has convex and concave structures, the first positioning groove is formed on the convex structure, and the second positioning groove is formed on the concave structure.

In an embodiment, the tongue piece has a plurality of first accommodating grooves for accommodating the first electrical contact part. The tongue piece has a plurality of second accommodating grooves for accommodating the second electrical contact part.

In an embodiment, the first terminals include at least a pair of signal receiving terminal and a pair of signal transmitting terminal are provided in. The second terminals have at least a pair of USB 2.0 terminals. The data transmission of the plurality of first terminals and second terminals are both implemented according to the USB 3.0 specification. The second terminals are implemented according to the USB 2.0 specification. In an embodiment, the first positioning part is perpendicular to the first bonding part, and the second positioning part is perpendicular to the second bonding part.

The present invention further proposes another electrical connector, comprising: an insulative body comprising a base and a tongue piece protruding from the base, the base having a plurality of positioning parts and a plurality of positioning grooves between the positioning parts; a plurality of first terminals penetrating and disposed in the insulative body, each of the first terminals having a first positioning part received in the insulative body, a first bonding part outwardly bending from the first positioning part and protruding from the base, and a first electrical contact part outwardly bending from the second positioning part and protruding from the tongue piece; a plurality of second terminals penetrating and disposed in the insulative body, each of the second terminals having a second positioning part received in the insulative body, a second bonding part outwardly bending from the second positioning part and protruding from the base, and a second electrical contact part outwardly bending from the second positioning part and protruding from the tongue piece; an adhesive filled in the first positioning groove to be coupled with the positioning part and encapsulate the second positioning part within the positioning groove, and filled in the second positioning groove to be coupled with the second positioning part and encapsulate the second bonding part within the second positioning groove; and a shielding housing for receiving the insulative body, the plurality of first terminals and the plurality of second terminals, wherein an accommodating space is formed between the shielding housing and the tongue piece for a peripheral device to be plugged thereinto.

In summary, the electrical connector according to the present invention differs from the electrical connector according to the prior art in that the electrical connector according to the present invention utilizes a thermal-melting adhesive to bond the first terminals and/or second terminals on the base of the insulative body. As a result, the overall cost for assembly is reduced, and first terminals and/or second terminals can be more securely positioned in place.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The present invention is described in the following with specific embodiments, so that one skilled in the pertinent art can easily understand other advantages and effects of the present invention from the disclosure of the present invention. It is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements. In addition, words such as "on", "top" and "a" are used to explain the preferred embodiment of the present invention only and should not limit the scope of the present invention.

Figure 1:
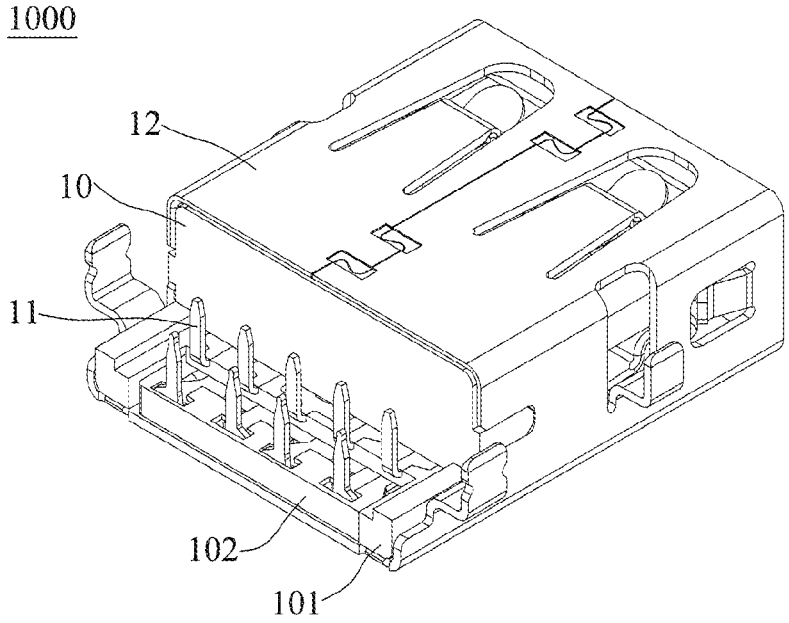
FIG. 1 (PRIOR ART)
FIG. 1 is a 3 dimensional view of a conventional electrical connector.
Figure 2:
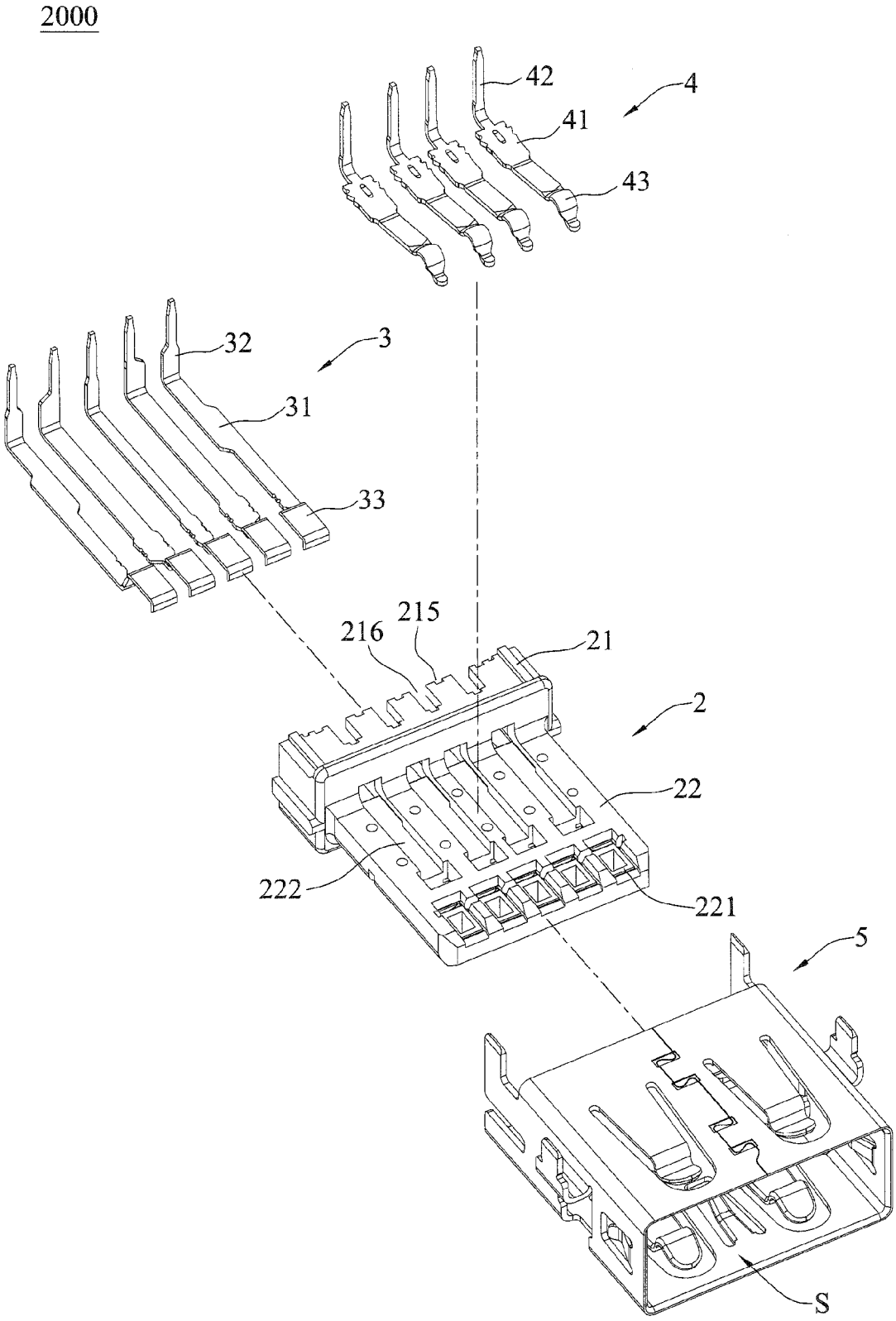
FIG. 2 is a decomposed view of an electrical connector in accordance with a first embodiment of the present invention.
Figure 3:
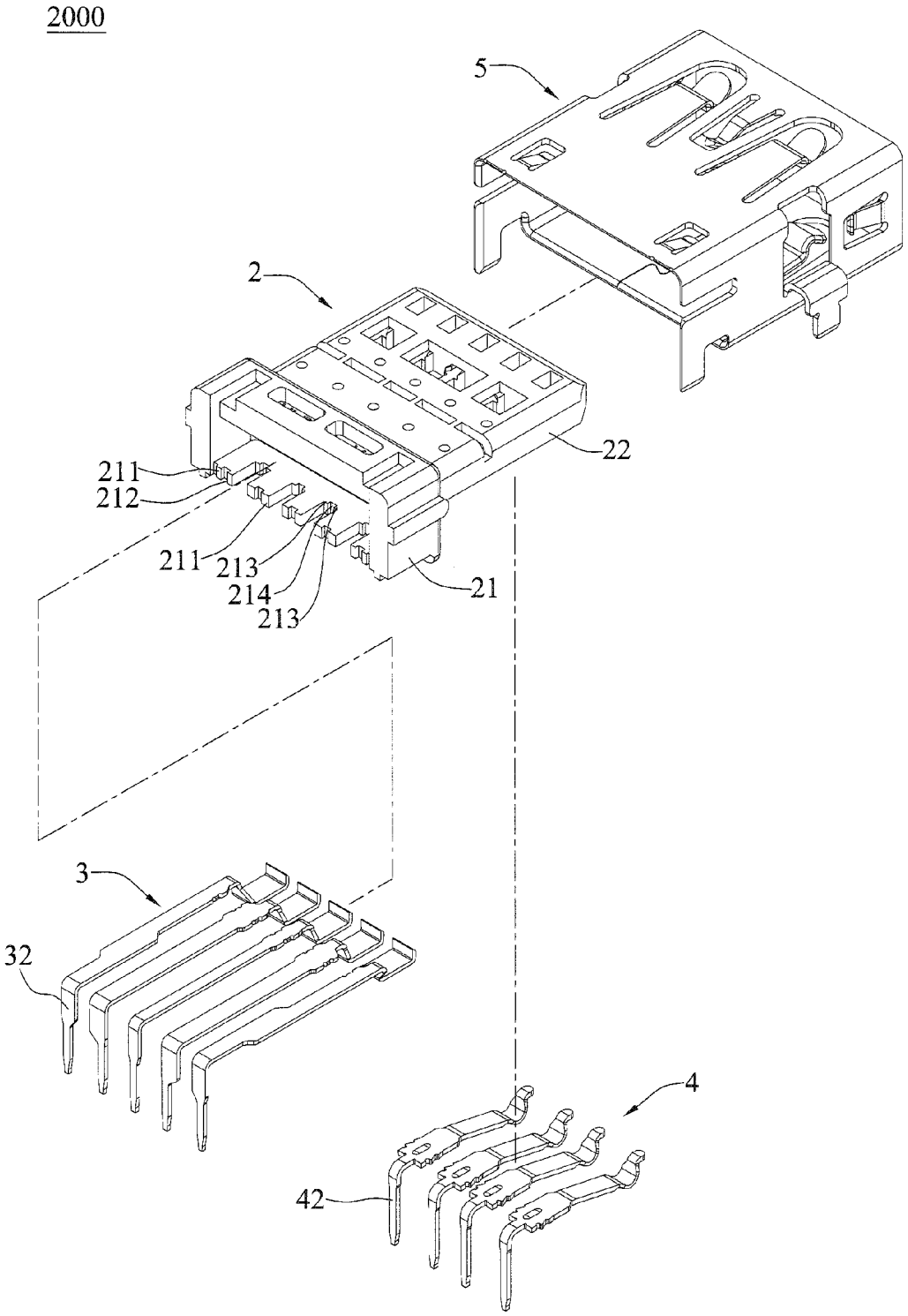
FIG. 3 is another decomposed view of the electrical connector in accordance with the first preferred embodiment of the present invention.
Figure 4:
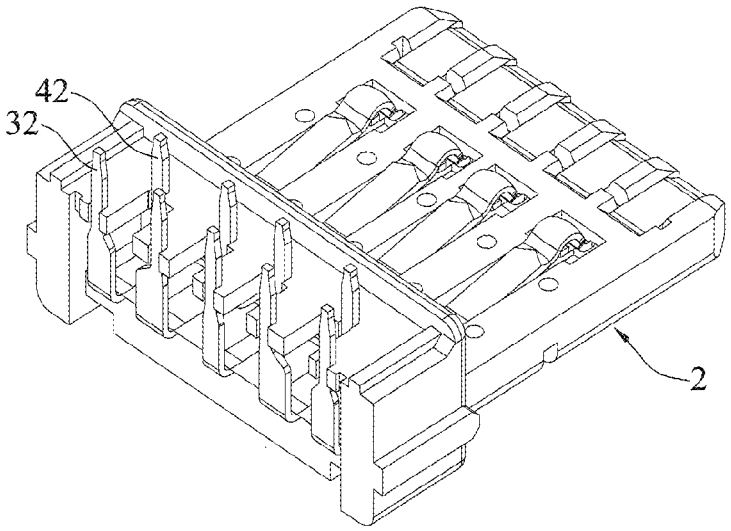
FIG. 4 is a schematic view showing the electrical connector that has not yet filled with an adhesive in accordance with the first preferred embodiment of the present invention.
Figure 5:
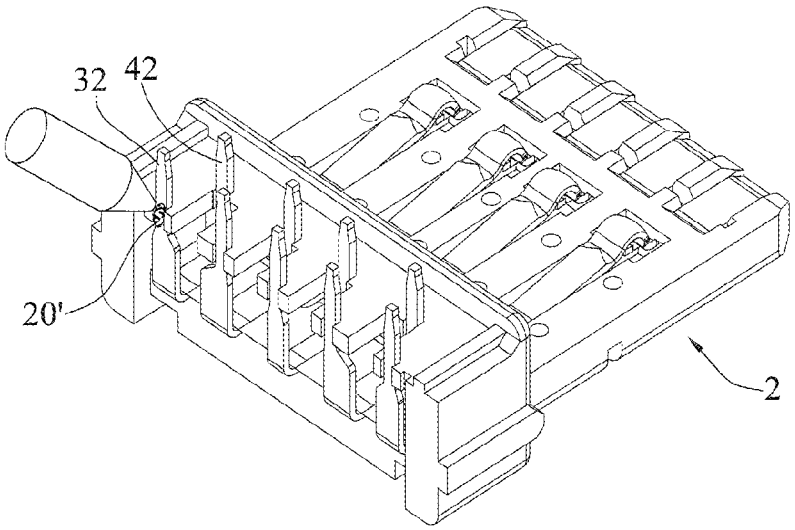
FIG. 5 is a schematic view showing the electrical connector that is filled with an adhesive in accordance with the first preferred embodiment of the present invention.
Figure 6:
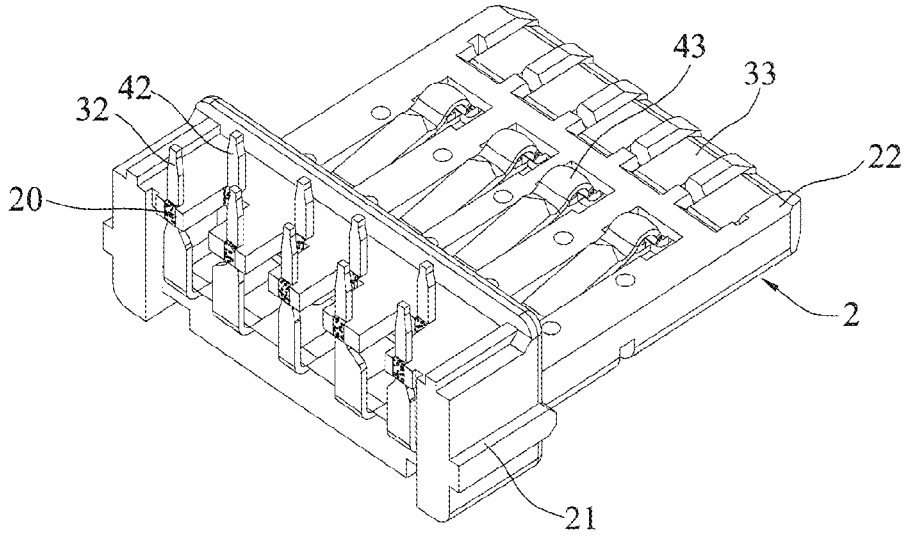
FIG. 6 is a schematic view showing the electrical connector that is filled with an adhesive in accordance with the first preferred embodiment of the present invention.

Referring to FIGS. 2 to 6, the schematic views of an electrical connector 2000 of a first preferred embodiment according to the present invention are shown. FIGS. 2 and 3 are exploded views of the electrical connector 2000 of the first preferred embodiment according to the present invention. FIGS. 4-6 are schematic views of the electrical connector 2000 that has not yet been filled, is filled, and has been filled with an adhesive, respectively, in accordance with the first preferred embodiment of the present invention.

The electrical connector 2000 installed in an electronic device comprises an insulative body 2, a plurality of first terminals 3, a plurality of second terminals 4, a shielding housing 5, and an adhesive 20.

The insulative body 2 comprises a base 21 and a tongue piece 22. The tongue piece 22 protrudes from the front side of the base 21. The back side of the base 21 has a plurality of first positioning part 211, a plurality of first positioning grooves 212 between corresponding two of the first positioning parts 211, a plurality of second positioning parts 213, and a plurality of second positioning grooves 214 between corresponding two of the second positioning parts 213. The base 21 has a convex structure 215 and a concave structure 216 adjacent to the convex structure 215. The positioning grooves 212 are formed in the convex structure 215. The second positioning grooves 214 are formed in the concave structure 216.

The second terminals 4 are formed penetrating and disposed in the insulative body 2 through an injection molding method. Each of the second terminals 4 has a second positioning part 41, a second bonding part 42, and a second electrical contact part 43. The second positioning part 41 is received in the insulative body 2. The second bonding part 42 is formed by outwardly bending from the second positioning part, accommodated in a corresponding one of the second positioning grooves 214, and protruded from the base 21. The second positioning part 41 and the second bonding part 42 are perpendicular to each other to form an L shape. The second electrical contact part 43 is formed by outwardly bending from the positioning part 41 and is protruded from the tongue piece 22. The tongue piece 22 has a plurality of second accommodating grooves 222 near the base 21, for accommodating the second electrical contact part 43. The second terminals 4 function according to the USB 2.0 protocol. The first terminals 3 and the terminals 4 transmit signals according to the USB 3.0 protocol.

The adhesive 20 is formed in the first positioning groove 212. The adhesive 20 is coupled with the first positioning part 211 to encapsulate the first bonding part 32 in the first positioning groove 212. The adhesive 20 is formed in the second positioning grove 214. The adhesive 20 is coupled with the second positioning part 213 to encapsulate the second bonding part 42 in the second positioning groove 214. In an embodiment, the adhesive 20 is a thermal-melting material which is thermal-melting to be formed on the base 21, as shown in FIGS. 4-6, wherein the melt adhesive 20' is injected into the first positioning groove 212 and the second positioning grooves 214, and covering the first bonding part 32 and second bonding part 42. After the adhesive 20 is cooled down, the first bonding part 32 and the second bonding part 42 are securely positioned on the base 21.

The shielding housing 5 receives the insulative body 2, the first terminals 3, and second terminals 4, and an accommodating space S is formed between the shielding housing 5 and the tongue piece 22 for a peripheral device to be plugged thereinto.

Figure 7:
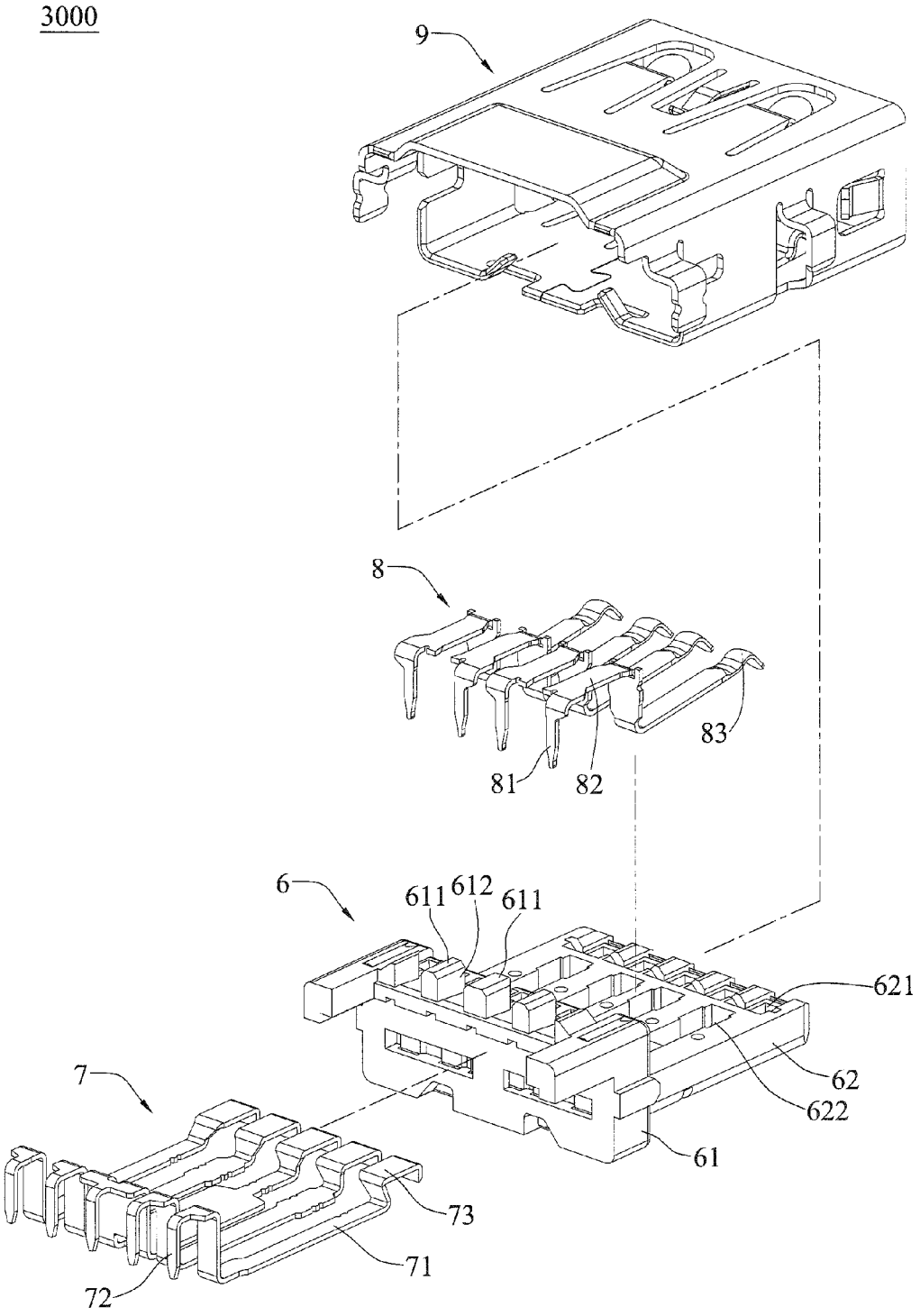
FIG. 7 is a decomposed view of an electrical connector in accordance with a second preferred embodiment of the present invention.
Figure 8:
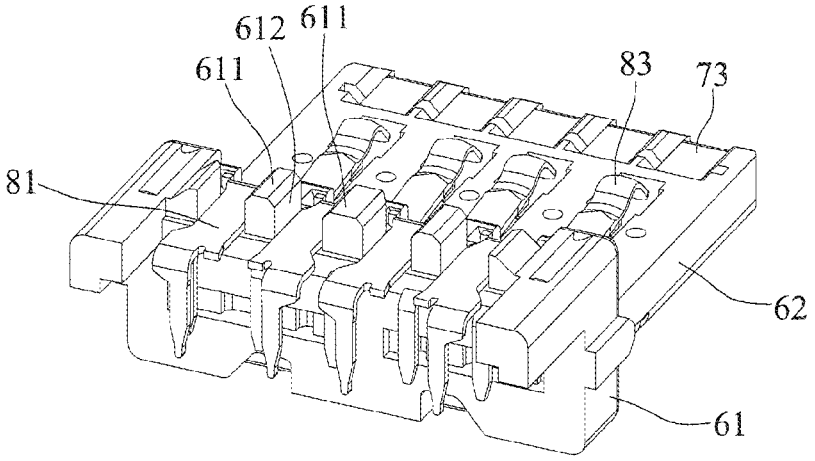
FIG. 8 is a schematic view showing the electrical connector that has not yet filled with an adhesive in accordance with the second preferred embodiment of the present invention.
Figure 9:
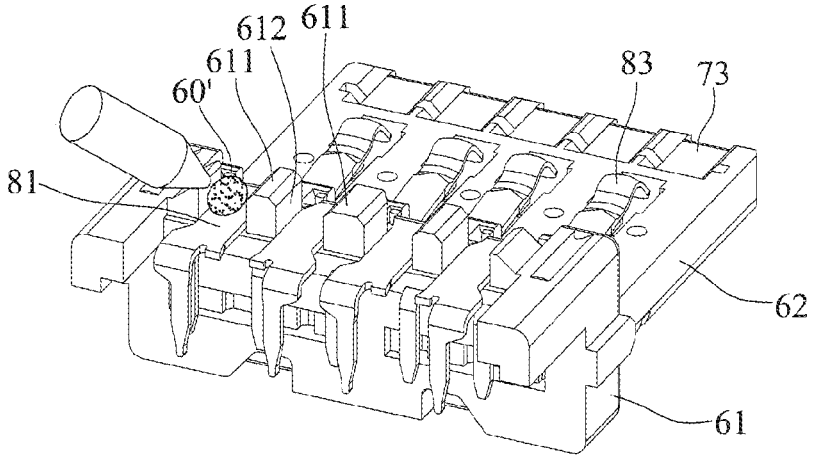
FIG. 9 is a schematic view showing the electrical connector that is filled with an adhesive in accordance with the second preferred embodiment of the present invention.
Figure 10:
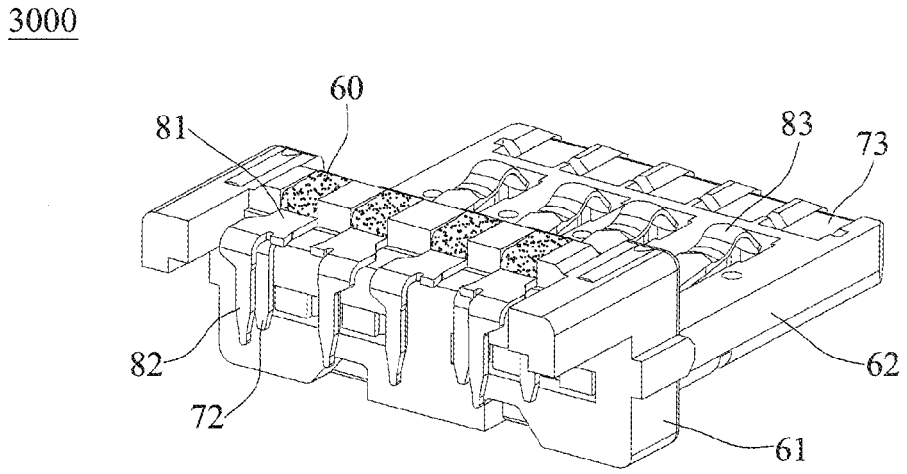
FIG. 10 is a schematic view showing the electrical connector that is filled with an adhesive in accordance with the second preferred embodiment of the present invention.

FIGS. 7-10 illustrate the electrical connector of a second preferred embodiment according to the present invention. FIG. 7 is the exploded view of the electrical connector of the second preferred embodiment according to the present invention. FIGS. 8-10 are schematic views the electrical connector that has not yet been filled, is filled and has been filled with the adhesive, respectively, in accordance with the second preferred embodiment of the present invention.

The insulative body 6 comprises a base 61 and a tongue piece 62 extending from the front side of the base 61. The base 61 has a plurality of positioning parts 611 and a plurality of positioning grooves 612 between the positioning parts 611. The tongue piece 62 has a plurality of first accommodating grooves 621 on the front side and a plurality of second accommodating grooves 622 between the first accommodating grooves 621 and the base 61.

The first terminals 7 penetrate the insulative body 6. Each of the first terminals 7 comprises a second positioning part 81, a second bonding part 82, and a second electrical contact part 83. The second positioning part 81 is accommodated in a corresponding one of the positioning grooves 612. The second bonding part 82 is formed by outwardly bending from the second positioning part 81 and protruding the base 61 and the tongue piece 62. The second electrical contact part 83 is accommodated in and exposed from the second accommodating groove 622.

The adhesive 60 is formed in the first positioning groove 612. The adhesive 60 is coupled with the positioning part 611 to encapsulate the second bonding part 81 in the positioning groove 612. In an embodiment, the adhesive 60 is a thermal-melting material, as shown in FIGS. 8-10, wherein the melt adhesive 60' is injected into the positioning groove, and covering the second bonding part 81. After the adhesive 60 is cooled down, the second positioning part 81 is securely positioned on the base 61.

The shielding housing 9 receives the insulative body 6, the first terminals 7 and the second terminals 8. An accommodating space (not labeled) is formed between the shielding housing 9 and the tongue piece 62 for a peripheral device to be plugged thereinto.

Figure 11:
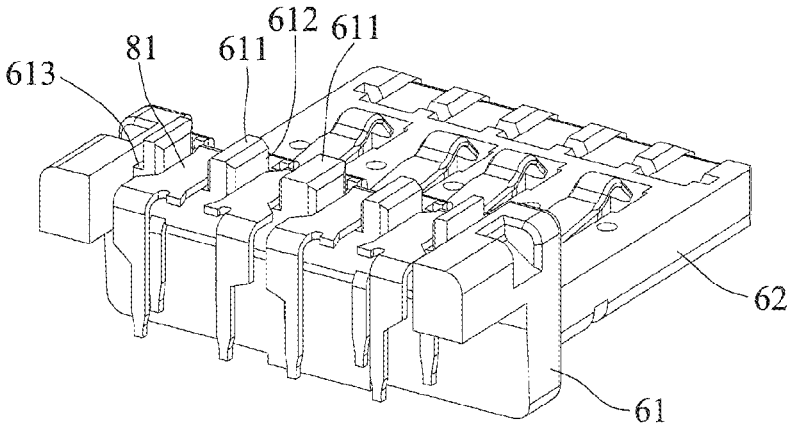
FIG. 11 is a schematic view showing the electrical connector that has not yet filled with an adhesive in accordance with a third preferred embodiment of the present invention.
Figure 12:
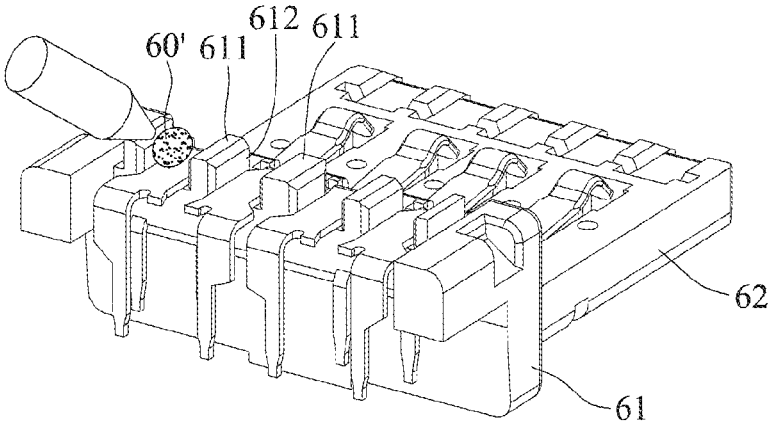
FIG. 12 is a schematic view showing the electrical connector that is filled with an adhesive in accordance with the third preferred embodiment of the present invention.
Figure 13:
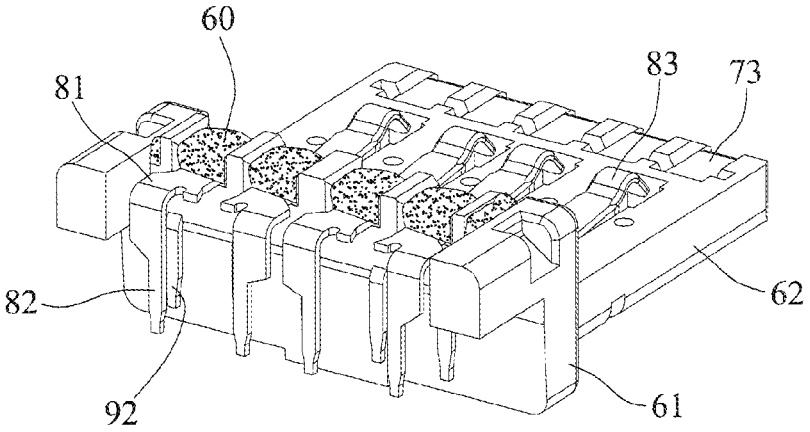
FIG. 13 is a schematic view showing the electrical connector that is filled with an adhesive in accordance with the third preferred embodiment of the present invention.

FIGS. 11-13 illustrate the electrical connectors of a third preferred embodiment according to the present invention. FIGS. 11-13 show that the insulative body 6 comprises a base 61 and a tongue piece 62 extending from the front end of the base 61. The base 61 has the positioning parts 611, positioning grooves each formed between the positioning parts 611, and grooves 613 positioned outside of the positioning parts 611. The second positioning parts 81 can be made wider to allow the second terminals 8 and the base 61 to be bonded more tightly.

As shown in FIGS. 11-13, a tool (not shown) is used to fill a thermal-melting adhesive 60' in the positioning grooves 612. The second positioning part 81 is covered by the thermal-melting adhesive 60'. After the adhesive 60 is cooled down, the second position part 81 is securely positioned on the base 61. In an embodiment, the grooves 613 prevent the thermal-melting from flowing beyond the positioning grooves 612 to the base 61, causing the subsequent assembly processes to be difficult to proceed. In summary, the adhesive used to connect the base and the terminals (first and second terminals in the first embodiment, and the second terminals in the second and third embodiments). Therefore, when the peripheral device (e.g., a hard disk) is rejected, the short-circuit problem due to the fact that the shielding housing is made of iron can be prevented. Thus, in the electrical connector proposed by the present invention, the thermal-melting adhesive provides an alternative way to securely position the first terminals and/or second terminals on the insulative body, replacing the conventional method of using a bump structure, therefore has the advantages of reducing the cost for assembly as well as providing secure positioning of the first and second terminals The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An electrical connector, comprising:

an insulative body comprising a base and a tongue piece protruding from the base, wherein the base has a plurality of first positioning parts, a plurality of first positioning grooves each formed between corresponding two of the first positioning parts, a plurality of second positioning parts, and a plurality of second positioning grooves each formed between corresponding two of the second positioning grooves;

a plurality of first terminals penetrating and disposed in the insulative body, each of the first terminals having a first positioning part received in the insulative body, a first bonding part outwardly bending from the first positioning part, accommodated in a corresponding one of the first positioning grooves and protruding from the base, and a first electrical contact part outwardly bending from the first positioning part and exposed from the tongue piece;

a plurality of second terminals penetrating and disposed in the insulative body, each of the second terminals having a second positioning part received in the insulative body, a second bonding part outwardly bending from the second positioning part, accommodated in a corresponding one of the second positioning grooves, and protruding from the base, and a second electrical contact part outwardly bending from the second positioning part and exposed from the tongue piece;

an adhesive filled in the first positioning grooves to be coupled with the first positioning parts and encapsulate the first bonding parts in the first positioning grooves, and filled in the second positioning grooves to be coupled with the second positioning parts and encapsulate the second bonding parts in the second positioning grooves; and a shielding housing for receiving the insulative body, the first terminals, and the second terminals, wherein an accommodating space is formed between the shielding housing and the tongue piece to function as a space for a peripheral device to be plugged thereinto.

2. The electrical connector of claim 1, wherein the adhesive is a thermal-melting adhesive.

3. The electrical connector of claim 1, wherein the base has concave and convex structures, the first positioning grooves are formed on the convex structure, and the second positioning grooves are formed on the concave structure.

4. The electrical connector of claim 1, wherein the tongue piece has a plurality of first accommodating grooves for accommodating the first electrical contact parts and a plurality of second accommodating grooves for accommodating the second electrical contact parts.

5. The electrical connector of claim 1, wherein the plurality of first terminals include at least a pair of signal receiving terminals and a pair of signal transmitting terminals.

6. The electrical connector of claim 1, wherein the second terminals have at least a pair of USB 2.0 signal terminals.

7. The electrical connector of claim 1, wherein the first terminals and second terminals send data according to the USB 3.0 protocol.

8. An electrical connector, comprising:

an insulative body comprising a base and a tongue piece protruding from the base, the base having a plurality of positioning parts and a plurality of positioning grooves each formed between corresponding two of the first positioning parts;

a plurality of first terminals penetrating and disposed in the insulative body, each of the first terminals having a first positioning part received in the insulative body, a first bonding part outwardly bending from the first positioning part and protruding from the base, and a first electrical contact part outwardly bending from the first positioning part and exposed from the tongue piece;

a plurality of second terminals penetrating and disposed in the insulative body, each of the second terminals having a second positioning part received in a corresponding one of the positioning groove, a second bonding part outwardly bending from the second positioning part and protruding from the base, and a second electrical contact part outwardly bending from the second positioning part and exposed from the tongue piece;

an adhesive filled in the positioning grooves to be coupled with the positioning parts and encapsulate the second positioning parts in the positioning grooves; and a shielding housing for receiving the insulative body, the first terminals, and the second terminals, wherein an accommodating space is formed between the shielding housing and the tongue piece to function as a space for a peripheral device to be plugged thereinto.

9. The electrical connector of claim 8, wherein the adhesive is a thermal-melting adhesive.

10. The electrical connector of claim 8, wherein the base comprises grooves disposed in a region outside of the positioning parts.

* * * * *